US007621424B1

(12) United States Patent
Antonacci

(10) Patent No.: US 7,621,424 B1
(45) Date of Patent: Nov. 24, 2009

(54) CONTAINER FOR ICE CREAM CONES

(76) Inventor: Tino Antonacci, 17 Park La., Park Ridge, IL (US) 60068

( * ) Notice: Subject to any disclaimer, the term of this patent is extended or adjusted under 35 U.S.C. 154(b) by 568 days.

(21) Appl. No.: 11/273,830

(22) Filed: Nov. 16, 2005

(51) Int. Cl.
*B65D 85/62* (2006.01)
*B65D 25/24* (2006.01)
*B65D 85/30* (2006.01)

(52) U.S. Cl. ..... 220/675; 220/636; 220/630; 206/499

(58) Field of Classification Search ..... 220/675, 220/636, 630; 206/499
See application file for complete search history.

(56) References Cited

U.S. PATENT DOCUMENTS 648,436 A * 5/1900 Rider ..... 215/377
882,378 A * 3/1908 Freindlich ..... 604/20
1,326,519 A * 12/1919 McLaren ..... 206/499
1,541,532 A * 6/1925 Simmons ..... 229/201
1,682,933 A * 9/1928 Potts ..... 221/33
3,039,881 A * 6/1962 Shapiro ..... 426/119
3,526,335 A * 9/1970 Swett et al. ..... 220/630
3,706,394 A * 12/1972 Merz ..... 221/75
4,349,571 A * 9/1982 Davis et al. ..... 426/124
4,890,757 A * 1/1990 Robbins, III ..... 220/675
4,899,884 A 2/1990 Madsen
5,232,146 A 8/1993 Antonacci
5,427,246 A * 6/1995 Hadjikhani ..... 206/554
5,501,363 A * 3/1996 Muller et al. ..... 220/630
6,047,849 A * 4/2000 Schwegman et al. ..... 220/737
6,164,473 A * 12/2000 Waldrip ..... 215/378
6,772,904 B1 * 8/2004 Gilliam et al. ..... 220/836
7,364,048 B2 * 4/2008 Cautereels et al. ..... 220/254.7
2001/0022304 A1 * 9/2001 Roche ..... 220/212
2001/0050264 A1 * 12/2001 Schorner ..... 215/237
2003/0098311 A1 * 5/2003 Parentini ..... 220/630
2004/0011691 A1 * 1/2004 Autler et al. ..... 206/499
2004/0134919 A1 * 7/2004 Irwin et al. ..... 220/630

* cited by examiner

*Primary Examiner*—Anthony D Stashick
*Assistant Examiner*—Niki M Eloshway
(74) *Attorney, Agent, or Firm*—Patnaude & Videbeck

(57) ABSTRACT

A package for storing and transporting a stack or column of nested ice cream cones that is hollow, round in circumference with a cylindrical top portion and a conical bottom portion that converges toward a radially extending base. A circular cover snaps on an open top and an enclosure snaps on the bottom to form a base. The package is made of food safe plastic and is shaped to look like a baseball bat.

12 Claims, 1 Drawing Sheet

10
14
3
22
11
12
13
23
3

16
11
16
12
13

14
11
12
26
27
15
25

14
20
11
21

15

14

21
11
22

26
27
25
36
32
30
13
31
15
37

CONTAINER FOR ICE CREAM CONES

This invention relates to packaging, and more particularly, to a multi-purpose tubular plastic package capable of both protecting a nested column of waffle or sugar-type ice cream cones and also acting as a toy baseball bat when empty.

BACKGROUND OF THE INVENTION

Ice cream cones have been made nestable, one within another, to enable them to be efficiently stored and packaged for ease of transportation. Packaging for nestable cones tends to either be a long package of a single column of nested cones, or a rectangular package of a plurality of columns of nestable cones positioned in rows with dividers therebetween. Once such package for a column of nestable cones may be found at U.S. Pat. No. 4,899,884 issued to Madson on Feb. 13, 1990. This patent is cited in applicant's prior existing patent for an ice cream cone package, U.S. Pat. No. 5,232,146 issued Aug. 3, 1993. These patents disclose ice cream cone packages suitable for storing and transporting a nested column of ice cream cones in a cardboard container. The bottom end of a column of nested ice cream cones comes to a point. The packages disclosed in both of the prior patents disclose converging baffles in one and an upper end having a narrowed portion to symbolize the handle end of a baseball bat in the other. Both of these packages have been made out of cellulose or cardboard material. While baked goods used to be a locally made commodity, the global economy has provided for baked goods to be made and shipped over long distances.

With the advent of the global marketplace a need has developed for stronger packaging that can be used to more safely transport and store fragile ice cream cones across the country or around the world.

It is therefore an object of the invention, generally stated, to provide a new and improved packaging for nestable and stackable ice cream cones.

Another object of the present invention is to provide a stronger less expensive package for ice cream cones that can withstand the rigors of cross country and global shipping.

A further object of the invention is to provide a improved ice cream cone package that has a useful life after the cones therein have been removed and consumed.

SUMMARY OF THE INVENTION

The invention resides in a package made of food safe material for transporting and storing food stuffs that comprises a hollow generally cylindrical body including an upper cylindrical portion having an open top. The main body also includes a lower converging or conical portion extending below the cylindrical portion. A circular cap or cover 18 selectably releasably retained on the open top of the generally cylindrical body. A radially extending base means is positioned subjacent a bottom of the conical portion for providing a widened base for the package. The generally cylindrical body, cap and radially extending base means resembles the shape of a baseball bat.

BRIEF DESCRIPTION OF THE DETAILED DRAWINGS

The features of the present invention which are believed to be novel are set forth with particularity in the appended claims. The invention may best be understood by reference to the following description taken in conjunction with the accompanying drawings in which like numerals refer to like parts, and in which:

DETAILED DESCRIPTION OF THE PREFERRED EMBODIMENT

Figures 1, 2, 3, 4, 5, 6, 7, 8:
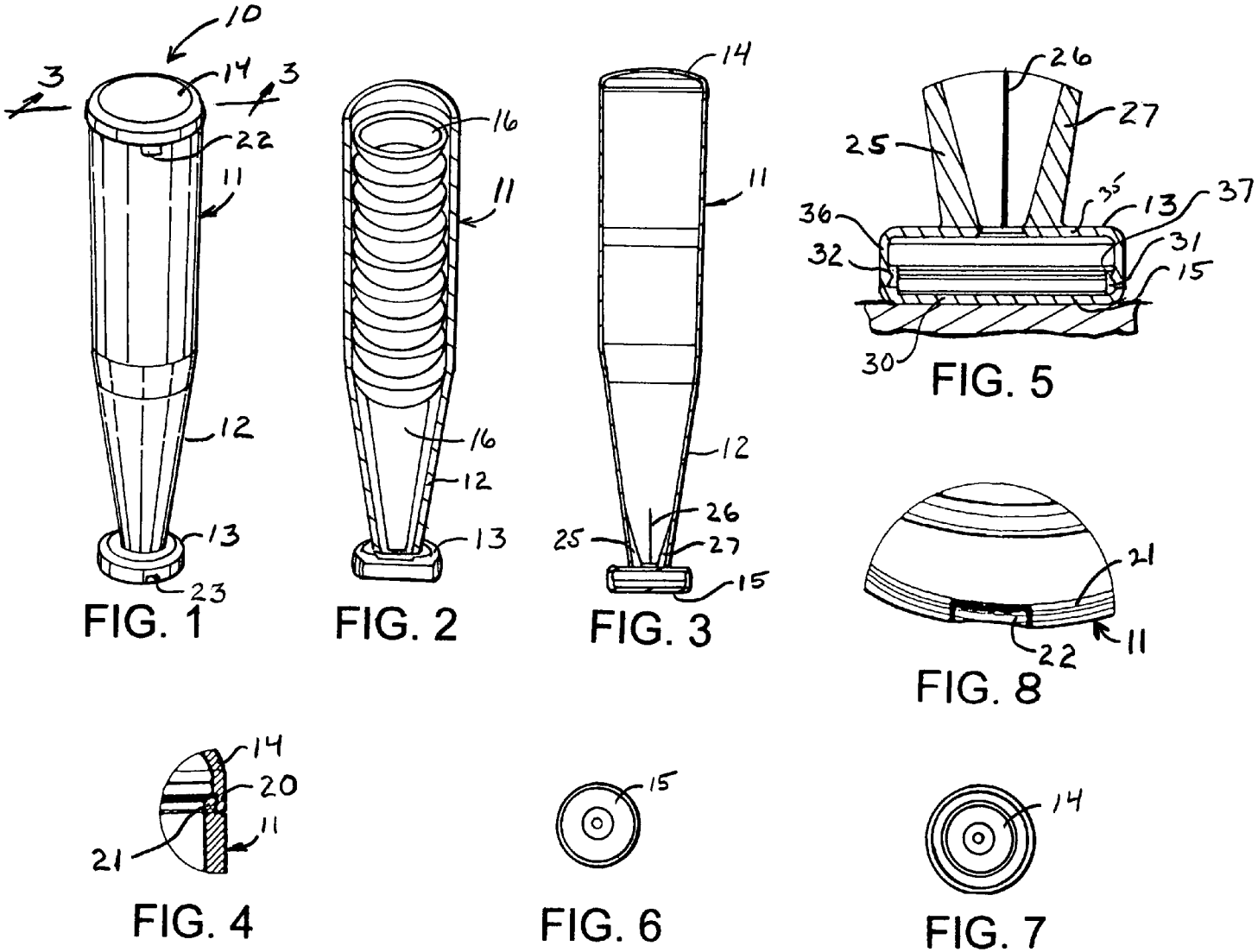
FIG. 1 is a front perspective view of a package for shipping and storage of ice cream cones constructed in accordance with the present invention.
FIG. 2 is a fragmentary vertical cross sectional view of the package shown in FIG. 1 as it appears without a top cover and with a stack of complete nested ice cream cones positioned therein.
FIG. 3 is a vertical cross section view of the package shown in FIG. 1, taken substantially along line 3-3 of FIG. 1.
FIG. 4 is an enlarged fragmentary detail view of the joinder shown in FIG. 3 between the cover and body of the package of the invention.
FIG. 5 is a fragmentary detail cross sectional view of the bottom of the package shown in FIG. 3.
FIG. 6 is a bottom plan view of the package shown in FIG. 1.
FIG. 7 is a top plan view of the package shown in FIG. 1.
FIG. 8 is an enlarged fragmentary detail plan view of a portion of the top rim of the package showing the thumb recess thereon.

Referring to FIGS. 1 through 5, the ice cream cone storing and shipping container, generally indicated at 10, constructed in accordance with the present invention, is made of food safe plastic, preferably polypropylene, and includes a central cylindrical or body portion, generally indicated at 11 at the bottom of the cylindrical portion 11 and integrally formed therewith is a converging or conical portion 12. At the base of the conical portion is a radially extending rib, donut section, or flange 13.

Referring to FIGS. 3, 4 and 5, the generally cylindrical body 10 further includes a cylindrical cap or cover 14 and a bottom or base 15 with each mounted on opposing ends of the generally cylindrical body 11, such that the package, as an entirety, resembles the shape of a baseball bat.

The baseball bat shaped package is preferably made out of a molded plastic, food-safe material such as polyethylene, polypropylene, or the like, and may be wholly injection molded, partially or wholly blow molded, or made of a combination of different molded or fabricated parts. In a currently preferred embodiment, the package is about 14.2 inches long, 2.9 inches wide at the top with a base 2.2 inches wide and 0.92 inches high. The side wall thickness is 0.080 inch. The entire package weighs about 166 grams.

Referring to FIG. 2, sugar or waffle type cones, with sugar cones indicated at 16-16, are stacked in nested form and positioned as a column inside the generally cylindrical body 11 with the bottom of the cones 16 extending down into the hollow lower conical portion 12 of the generally cylindrical body 11.

Referring to FIGS. 1, 4, 7 and 8, the generally round cover or cap 14 includes a crowned top and an OG shaped rim, generally indicated at 20 in FIG. 4, that matingly engages a complimentary OG shaped rim 21 on the top of generally cylindrical body portion 11. The outer extension or distal end of each of the rims 20-21 is enlarged to provide interference, or snap fit, to the cap or cover 14 as it is pressed on the rim 21 of the generally cylindrical upper body portion 11. A thumb hole or recess 22, shown in FIGS. 1 and 8, is positioned in the outer wall of upper cylindrical body portion 11 just subjacent the OG upper rim 21 thereof to allow a thumb to be inserted therein to pry the cap or cover off the generally cylindrical body portion 11.

Referring now to FIGS. 3 and 5, as a strengthening aid at the bottom of the conical portion 12 of cylindrical body portion 11, a plurality of inwardly extending ribs, in this case 4 ribs, with 25, 26 and 27 shown provide additional stiffening support and bracing for the smaller conical bottom of the generally cylindrical tubular portion 11. In the preferred embodiment, the ribs are 0.060 inch thick. The inward extension of ribs 25, 26, 27, with the fourth rib not shown, does not extend so far as to restrict the entry of the bottom of cones 16-16 thereinto.

Referring to FIG. 5, the bottom or base 15 of the package 10 is generally saucer-like with a flat bottom 30 and an upwardly curving ridge 31 having an indented groove 32 positioned on the outer surface thereof. The upper portion of the heel includes a generally flat radially extending wall 35 with a tubular cylindrical wall 36 depending from the circumference thereof and including adjacent its distal end an outwardly extending detent or groove 37 that matingly engages the indent 32 on the base 15 to provide an interference fit over the upwardly extending wall 31 and provide snap-on capability of the base onto the heel 13. It should be noted that the indent-detent portions of the snap fit engagement could be reversed within the scope of the present invention. Also, as most clearly shown in FIG. 1, a second thumb hole or recess 23 is positioned adjacent the bottom edge of the donut section 13 of the generally cylindrical body 11. Thumb recess 23 is identical to thumb recess 22 and allows the base 15 to be snapped on or off of generally cylindrical portion 11.

A new and improved more rigid ice cream cone container has been shown and described that provides both improved stiffness and rigidity for storage and transportation of the substantially fragile ice cream cones and yet more closely resembles a baseball bat. It should be noted that when the ice cream cones stored or transported within the package 10 are utilized and the package is empty, that it may be utilized as a toy bat or a bat capable of hitting a hollow plastic ball such as sold under the trade name Wiffle Ball, or the like.

While one embodiment of the present invention has been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed is:

1. A package made of food safe material for transporting and storing food stuffs comprising:

a hollow generally cylindrical body including an upper cylindrical portion having an open top and a lower converging or conical portion extending therebelow;

a circular cap or cover selectably releasably retained on said open top of said generally cylindrical body, said cap including a snap fit ring adjacent a bottom thereof and said open top of said body including a complementary snap fit ring thereadjacent, a radially extending wall extending from adjacent a bottom of said conical portion of said generally cylindrical body and a cylindrical flange depending from a circumference of said radially extending wall, a base member having a substantially flat bottom and an upwardly extending circular wall around the circumference thereof, and complementary fastener means on said cylindrical flange and said circular wall for fastening said base member of said generally cylindrical body, said generally cylindrical body, said cap and said radially extending base means resembling the shape of a baseball bat.

2. The package as called for in claim 1 wherein said package is made of food safe polypropylene.

3. The package as called for in claim 1 wherein, a hollow interior of said conical portion of said generally cylindrical body includes a plurality of vertical ribs positioned in evenly spaced relation around said interior thereof.

4. The package as called for in claim 1 wherein said fastener means include complementary resilient interference rings on said cylindrical flange and said circular wall for matingly engaging same.

5. A package made of food save material for transporting and storing food stuffs comprising:

a hollow generally cylindrical body including an upper cylindrical portion having an open top and a lower converging or conical portion extending therebelow;

a circular cap or cover selectably releasably retained on said open top of said generally cylindrical body, said cap including a snap fit ring adjacent a bottom thereof and said open top of said body including a complementary snap fit ring thereadjacent, a radially extending wall extending from adjacent a bottom thereof and said open top of said body including a complementary snap fit ring thereadjacent, a radially extending wall extending from adjacent a bottom of said conical portion of said generally cylindrical body and a cylindrical flange depending from a circumference of said radially extending wall, a base member having a substantially flat bottom and an upwardly extending circular wall around the circumference thereof, and complementary resilient interference rings on said cylindrical flange and said circular wall for fastening said base member on said generally cylindrical body, a hollow interior of said conical portion of said generally cylindrical body includes a plurality of vertical ribs positioned in evenly spaced relation around said interior thereof, said generally cylindrical body, said cap and said radially extending base means resembling the shape of a baseball bat.

6. A package made of food safe material for transporting and storing food stuffs comprising:

a hollow generally cylindrical body including an upper cylindrical portion having an open top and a lower converging or conical portion extending therebelow;

a circular cap or cover selectably releasably retained on said open top of said generally cylindrical body, a radially extending base means positioned subjacent a bottom of said conical portion for providing a widened base for said package, a radially extending wall extending from adjacent a bottom of said conical portion of said generally cylindrical body and a cylindrical flange depending from a circumference of said radially extending wall, said base means including a base member having a substantially flat bottom and an upwardly extending circular wall around the circumference thereof, complementary fastener means on said cylindrical flange and said circular wall for fastening said base member of said generally cylindrical body, and said generally cylindrical body, said cap and said radially extending base means resembling the shape of a baseball bat.

7. The package as called for in claim 6 wherein said package is made of food safe polypropylene.

8. The package as called for in claim 6 wherein said cap includes a snap fit ring adjacent a bottom thereof, and said open top of said body includes a complimentary snap fit ring thereadjacent.

9. The package as called for in claim 6 wherein, a hollow interior of said conical portion of said generally cylindrical body includes, strengthening means for providing added structural strength thereto.

10. The package as defined in claim 9 wherein said strengthening means include, a plurality of vertical ribs positioned in evenly spaced relation around said interior thereof.

11. The package as called for in claim 6 wherein said fastener means include complementary resilient interference fit rings on said cylindrical flange and said circular wall for matingly engaging same.

12. The package as called for in claim 6 wherein said generally cylindrical body includes a thumb recess adjacent said cylindrical flange for easing manual disengagement of said cap from said body.

* * * * *